US006084211A

United States Patent [19]

Bauer

[11] Patent Number: 6,084,211

[45] Date of Patent: Jul. 4, 2000

[54] DEVICE FOR HEATING SCISSORS INSERTED IN RECPTACLES

[76] Inventor: Rudolf Bauer, Königstrasse 84, D-70173 Stuttgart, Germany

[21] Appl. No.: 08/875,754

[22] PCT Filed: Feb. 8, 1996

[86] PCT No.: PCT/EP96/00526

§ 371 Date: Oct. 15, 1997

§ 102(e) Date: Oct. 15, 1997

[87] PCT Pub. No.: WO96/24468

PCT Pub. Date: Aug. 15, 1996

[30] Foreign Application Priority Data

Feb. 9, 1995 [DE] Germany ..... 1950419.2

[51] Int. Cl.[7] ..... H05B 1/00

[52] U.S. Cl. ..... 219/242; 219/222; 219/506; 219/521

[58] Field of Search ..... 219/242, 227, 219/228, 229, 385, 521, 527; 224/610, 196, 904, 191, 681, 682, 232, 251, 265; 248/117.1–117.3, 117.5, 157, 421, 422, 176.2; 221/185, 209, 230, 236, 238; 34/202

[56] References Cited

U.S. PATENT DOCUMENTS

| | | | |
|---|---|---|---|
| 932,539 | 8/1909 | Denhard | 219/242 |
| 1,061,289 | 5/1913 | Heyder | 219/242 |
| 1,170,859 | 2/1916 | Walker | 224/251 |
| 1,462,392 | 7/1923 | Strickland | 219/242 |
| 1,625,487 | 4/1927 | Meyer | 219/242 |
| 2,326,572 | 8/1943 | Shangle | 219/242 |
| 2,592,484 | 4/1952 | Smith . | |
| 2,708,537 | 5/1955 | Dec | 224/196 |
| 3,637,120 | 1/1972 | Clay | 224/251 |
| 3,892,024 | 7/1975 | Van Zyl . | |
| 3,946,196 | 3/1976 | Waters et al | 219/242 |
| 4,103,145 | 7/1978 | Oliveri . | |
| 5,421,498 | 6/1995 | Menoni | 224/220 |
| 5,533,618 | 7/1996 | Pickels Jr. | 224/675 |

FOREIGN PATENT DOCUMENTS

| | | |
|---|---|---|
| 0 243 386 | 2/1990 | European Pat. Off. . |
| 1 502 767 | 2/1968 | France . |
| 2 391 820 | 12/1978 | France . |
| 2 407 797 | 6/1979 | France . |
| 2 532 878 | 3/1984 | France . |
| 2 612 381 | 9/1988 | France . |
| 92/00688 | 1/1992 | WIPO . |

OTHER PUBLICATIONS

Catalogue Rohstoff und Produkt by Dr. Kolitz, pp. 81–87.

*Primary Examiner*—Teresa Walberg
*Assistant Examiner*—Vinod D. Patel
*Attorney, Agent, or Firm*—Jones, Tullar & Cooper, P.C.

[57] ABSTRACT

The invention relates to a device for heating hairdressing scissors, forming a unit (3) comprising openings (2, 2') which can be used as holders (7, 7') into which pairs of scissors (5, 5') can be inserted, and heating devices (6, 6'), each of the heating devices (6, 6') encircling the space into which the pair of scissors is to be inserted.

10 Claims, 5 Drawing Sheets

FIG. 7
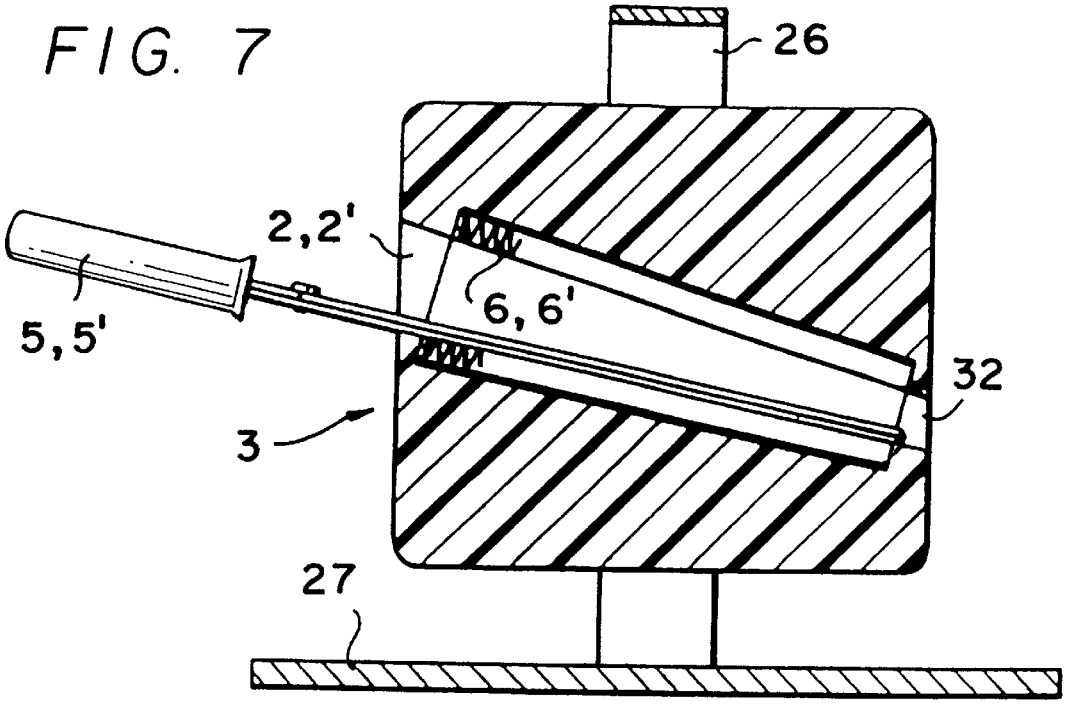
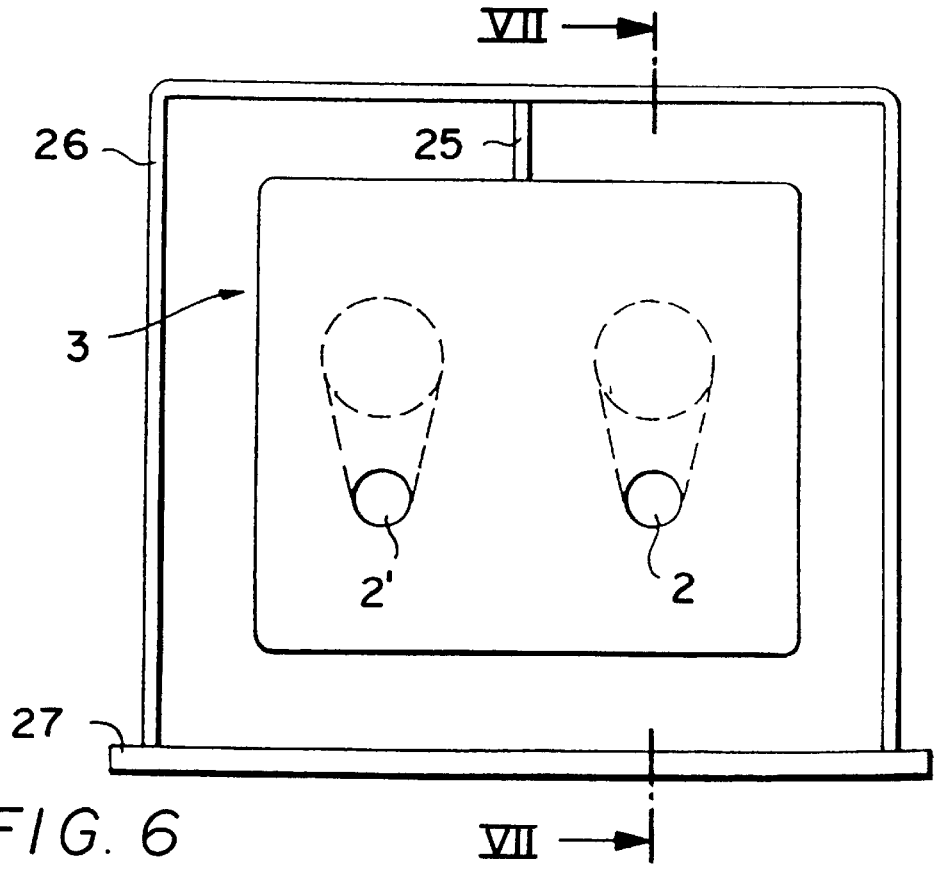
FIG. 6

DEVICE FOR HEATING SCISSORS INSERTED IN RECPTACLES

FIELD OF THE INVENTION

The present invention relates to a device for heating scissors a such as hairdressing scissors.

BACKGROUND OF THE INVENTION

The hair comprises three layers, namely the outer guard and gloss layer, which is the scaly or flakelike cuticle; a fibrous layer of spindle cells located below it, which is the actual hair shaft or so-called cortex; and finally—in the center of the hair—the core layer, or so-called medulla. This core layer is the moisture carrier for the hair. The moisture penetrates the hair from the scalp inward. If no further moisture is transferred, the hair becomes drier. The hair then behaves differently then.

A newly formed, never-cut hair strand is closed at its end and is thus protected against a loss of moisture. After cutting—over the approximately seven-year life of a single hair strand—however, there is continuously an open end that allows moisture to be lost. This can cause drying and splitting, especially with long hair.

For a rather long time, it has been known to preserve the natural moisture content in hair whose ends have been opened by cutting by sealing it again (cauterizing it) afterward. This has been done for instance using a lighted candle or a gas flame. However, this causes ugly scorched tips at the end of the hair and generally also causes thermal damage to the hair shaft. The attempt has already been made to cut hair using an electric glow wire (French Patent Disclosure FR 26 12 381). However, this greatly limits the flexibility in how to design the hair cut. Moreover, it is very inconvenient. The attempt has also been made to create directly heated scissors and knives (see published French Patent Applications FR 25 32 878 A1 and FR 24 07 797 A1; U.S. Pat. No. 3,892,028; and International Patent WO 92/00688). However, connecting the scissors to the supply lines and embodying the heating devices in the scissors themselves is extremely complicated, and the devices are difficult to manipulate and expensive to design. This cauterizing of the hair has therefore not yet been commercially used.

SUMMARY OF THE INVENTION

The object of the invention is to furnish a device that enables sealing of the ends of the hair in a simple way when hair is being cut.

According to the present invention this object is attained in by the provision of a unit having a scissors receptacle, suitable as holders for inserting scissors, and heating devices, and in which the heating device surrounds the space intended for receiving the scissors.

The present invention accordingly heats the scissors—preferably at least two pairs of scissors in alternation—in a device for heating scissors to be provided separately, from which the scissors are taken and used for cutting. The heating is done to a temperature that seals the cut ends of the hair during cutting. This occurs at a temperature of approximately 150° C. or higher. To insure that this will last for approximately 6 to 12 seconds, the scissors should be heatable in a device for heating scissors up to an—adjustable—temperature between 150° C. and 250° C.

In one further feature it is provided that a unit has at least two receptacles for scissors, in which in alternation one pair of scissors is heated while another is being used, so that an operator always has one pair of heated scissors available.

Another advantageous feature of the present invention provides that the unit is carried on a belt or the like on the body of the operator, so that the scissors are always ready at hand in an ergonomically appropriate way. Naturally, the unit may also be embodied as a stand-type unit, or both possibilities (suspension and standing) can be combined by means of a suitable embodiment.

Exemplary embodiments of the present invention and their advantageous further development will be described below in conjunction with the accompanying drawings.

BRIEF DESCRIPTION OF THE DRAWINGS

FIG. 6, shows a third exemplary embodiment of the present invention;

FIG. 7, a section taken along shows an line VII—VII of FIG. 6.

DETAILED DESCRIPTION OF THE PREFERRED EMBODIMENTS

Figure 1:
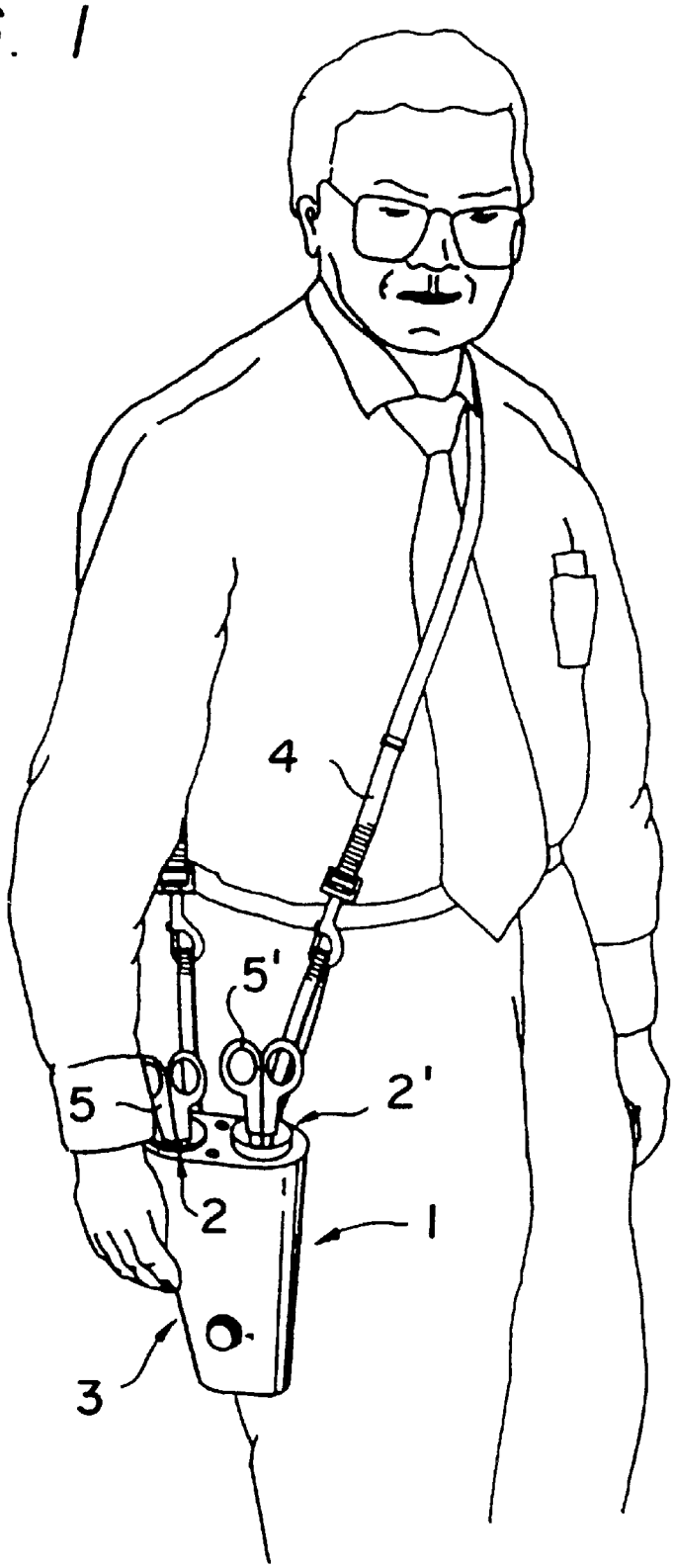
FIG. 1, shows a device for heating scissors including a holster.
Figure 2:
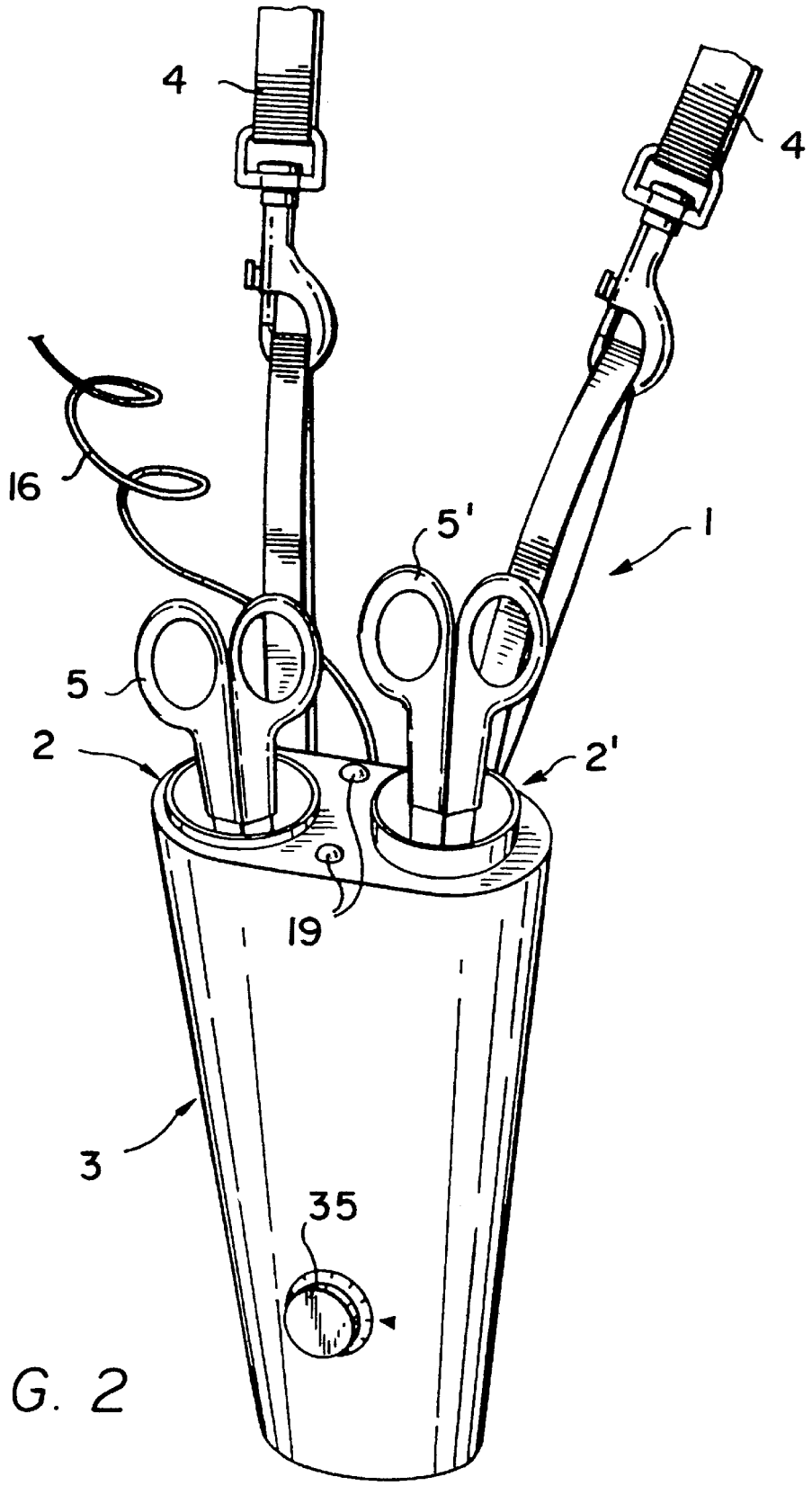
FIG. 2, shows the device for heating the scissors of FIG. 1 on a larger scale.

It can be seen from FIGS. 1 and 2 that the device 1 for heating scissors is formed by two quill-like scissors receptacles 2, 2', which are combined in one housing 3. This housing 3 is worn on the body of a hairdresser on suitable hanger straps 4, for instance being worn at hip level in an ergonomically favorable way. The scissors 5, 5' in the receptacles 2, 2' can then be easily inserted and removed at any time without having to look. This can be done in alternation, so that one pair of scissors is being heated while the other is being used.

Figure 3:
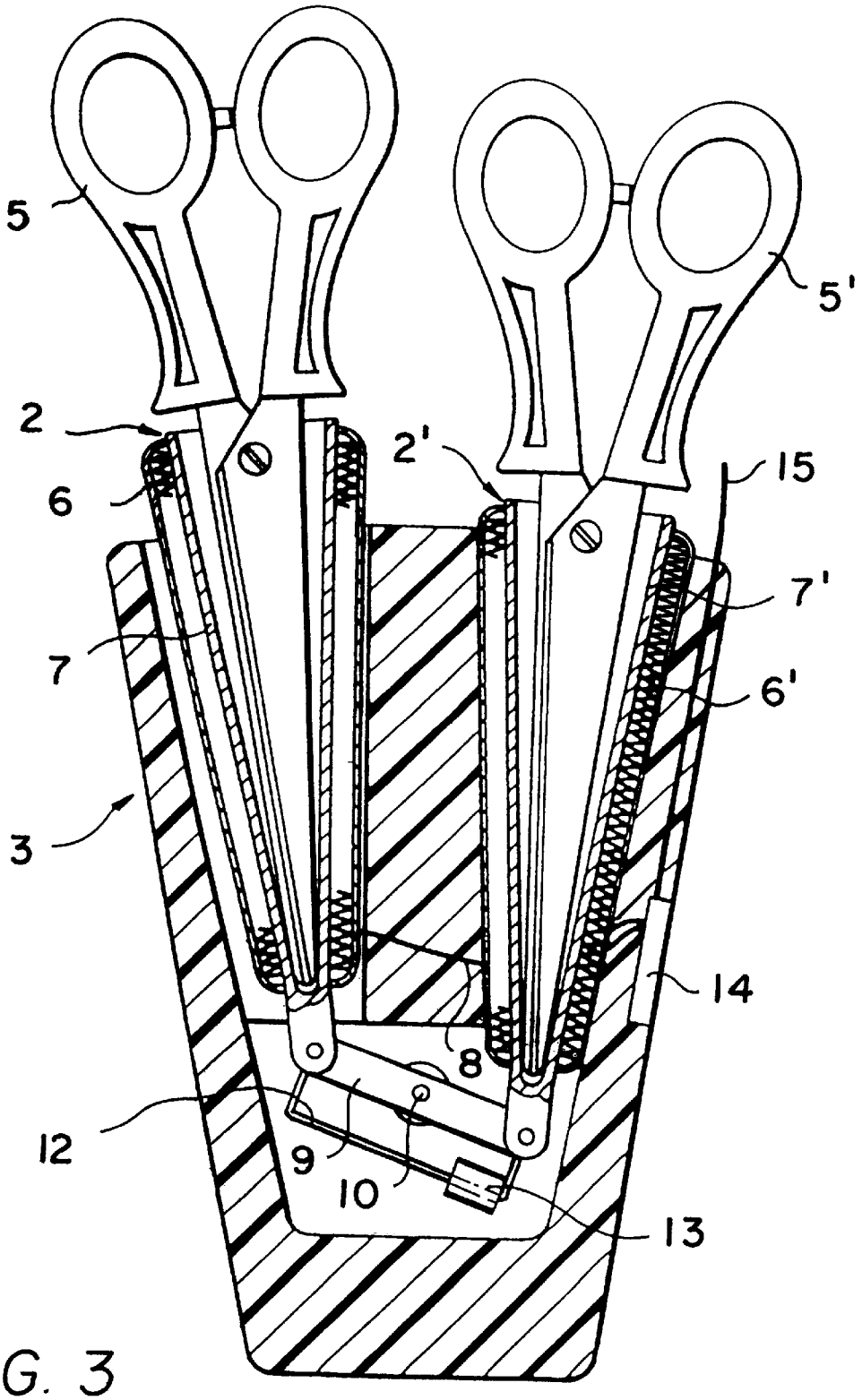
FIG. 3, shows a section through the device for heating scissors of FIG. 2.

FIG. 3 shows the receptacles 2, 2' in the housing 3 in detail. The receptacles comprise conically tapering holders 7, 7', which are surrounded by heating devices 6, 6', somewhat in the manner of a hot wax glue gun. These heating devices can be embodied by spiral heating wires, glued-on hot resistors, or the like, which are supplied with electric current via lines 8. To the outside, that is, toward the side that is not in contact with the holders 7, 7', the heating devices 6, 6' should be well insulated. The holders are pivotably connected at their lower ends to the ends of a lever 9 in a rotatable way. The lever is in turn rotatable in the housing 3 on the shaft 10 and is provided with a bracket 11, which has a rail segment 12, parallel to the lever, along which one can slide a weight 13.

If the two scissors receptacles 2, 2' are in the position shown in FIG. 3, and a hairdresser is now using the pair of scissors 5, then the receptacle 2 is empty. Once the scissors 5 as it is being used has cooled down enough that the operator wants to change scissors, he will insert the scissors 5 in the receptacle 2 and in the process, even possibly without intentionally exerting additional force, or in other words solely by allowing it to slide inward, presses the receptacle 2 downward far enough that the lever 9 tilts, or in other words changes its position in such a way that the left-hand end—relative to a horizontal—is located at a lower level than the right-hand end. Appropriate stops (not shown) should be provided. In this tilting, the weight 13 slips to the left on the rail segment 12 and now—unlike the position shown in FIG. 3—holds the receptacle 2 at the bottom in the tilted position. The receptacle 2' is shifted upward in the process. This latter pair of scissors now has "its turn" in the scissors dispenser. In this way, with simple means, bistable fixation of the two receptacles 2, 2' is created, depending on which pair was inserted more recently to be heated. Hence, without looking, an operator can on the one hand both tell which one of the two receptacles is unoccupied, so that the scissors that is now to be inserted will be inserted precisely there rather than in the other receptacle. At the same time, the operator can tell which one of the two pairs of scissors is the one he needs to use now, or in other words the one that has been heated and accordingly is to be removed. This is in fact the pair that now protrudes farther upward than the other one from the housing 3.

Figure 3A:
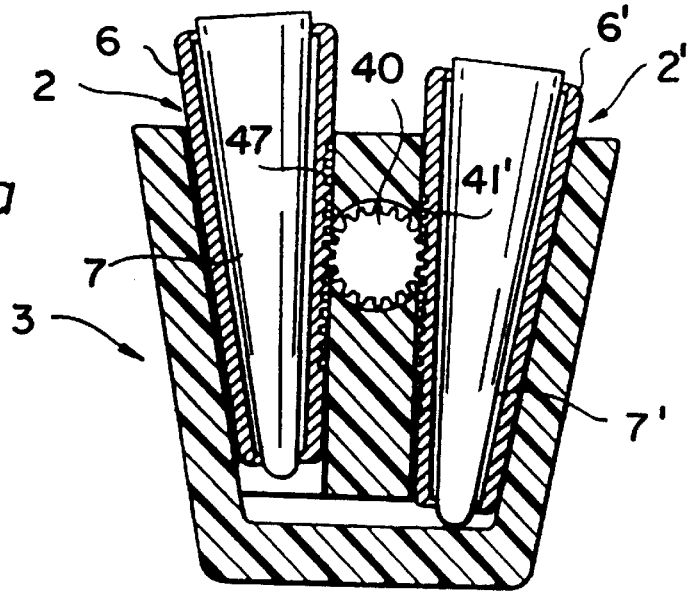
FIG. 3*a*, shows a second exemplary embodiment of the present invention.

As an alternative to this embodiment, it is possible, as shown in FIG. 3*a*, to provide a gear wheel 40 between the receptacles 2, 2', which meshes with two racks 41, 41', one of which is disposed on the one receptacle 2 and the other on the other receptacle 2'. Thus if one pair of scissors is inserted into the one receptacle and pressure in the insertion direction is exerted thereby, then by the operational connection described, a change of direction is brought about and hence a motion of the other receptacle counter to the insertion direction.

It will be understood immediately that in this kind of bistable retention the receptacles can be achieved by other means as well.

The line 8 leads to a connecting element 14 and from there via lines 15 to a spiral cable 16 (see FIG. 2), which above the housing 3 is still connected by some distance to a hanger strap 4 and from there can be extended away to an electrical outlet in the wall. This is important so that when the operator moves, pulling on the spiral cable will not cause the housing 3 to tilt.

Figure 4:
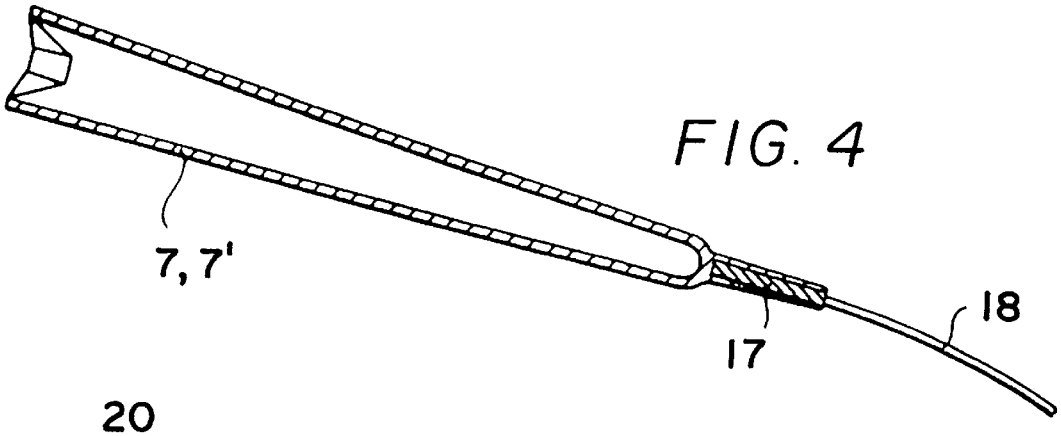
FIG. 4, shows the heating of a holder of a device for heating scissors in a modification of the first exemplary embodiment.

The heating of the scissors 5, 5' can also be accomplished by other means, for instance in the manner of a soldering iron. In that case, the holders 7, 7' must be embodied in the way shown in FIG. 4. Adjoining the actual holders, a resistance element 17 is provided, to which electric current is supplied through a line 18. It will be understood immediately that the holders 7, 7' must be insulated toward the outside in some suitable way. It may also be expediently provided that the heating is regulated; that is, that temperature sensors are mounted in the holders 7, 7' in the vicinity of the insertion opening, or in other words at the top in FIG. 3 or on the left in FIG. 4, which upon reaching a certain temperature discontinues the supply of current by which the heating is done, and when the temperature drops below a certain minimum value turns the heating back on again. It is then also possible, as can be seen from FIG. 2, to provide indicator lights 19, so that if desired, one can also see from above whether and which one of the two pairs of scissors has just been heated up. Such regulating circuits for heating devices are known to one skilled in the art, however, so that they require no further explanation in the present context. What is important for embodying the heating device is that it be lightweight, small, and well-insulated toward the outside. It will also be immediately apparent that the form of the scissors receptacles should be adapted as closely as possible to the outer contour of the scissors to be inserted, in order to insure an optimal positional contact between the scissors and the respective holders 7 or 7'.

Figure 5:
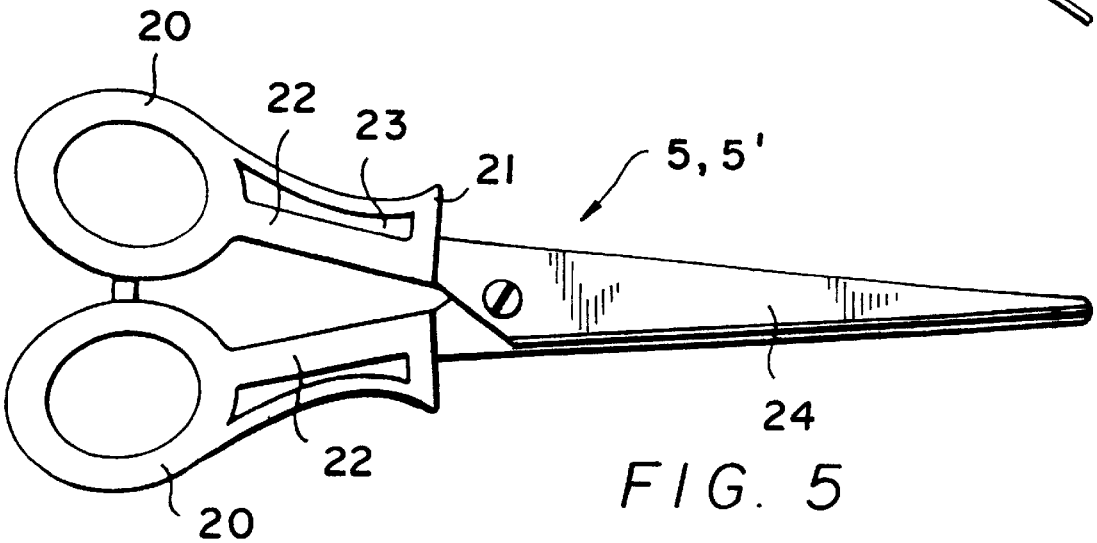
FIG. 5, shows the embodiment of a pair of scissors.

The design of the scissors must be especially adapted to this intended use, as can be seen from FIG. 5. The handle 20 must be well-insulated. The ends 21 of the insulation should be widened somewhat and embodied in such a way that they form a rest for the index finger for the hand of the operator, so that the operator will not touch the heated metal blade by mistake. The insulation of the handle 20 must comprise some suitable high-grade insulating plastic. It is also recommended that the shank parts 22 of the handles be provided with openings 23, to improve cooling with ambient air.

The exposed metal blades 24 of the scissors should be dark and matte in color, for instance by burnishing them. This prevents heat discoloration and spots caused by scorched parts of the hair. Moreover, this kind of embodiment of the surfaces of the blades 24 of the scissors assures better heat uptake inside the holders 7, 7', in contrast to highly reflective surfaces, for instance of chromium.

For better visual perception during use, it is often expedient to provide the two scissors with different colors of handles, so that beyond the aids already described (tilted position, indicator lights), the operator can assign scissors of a particular color to the position of a particular receptacle, for instance green ones at the front and red ones at the back.

FIGS. 6 and 7 show an exemplary embodiment with an alternative positioning of the housing 3. The housing 3 hangs from an arm 25. This arm in turn is connected to a bracket 26. This bracket 26 is embodied like an upside-down U and stands with its ends on a base 27 and is connected to it. The unit 3 has two side-by-side scissors receptacles 2, 2'. The suspension from an arm 25 and a bracket 26 in the manner shown prevents heat transfer from the housing 3 to the surface on which the housing stands. It is understood, however, that to the extent that the holders are sufficiently well heat-insulated in the housing, a housing can also be placed on a suitable surface without such a recess.

In FIG. 7, the receptacles 2, 2' are disposed in an inclined fashion. This makes it easier to insert the scissors. Moreover, the rear openings 32 are open, so that snippets of hair that stick to the scissors and come loose again later can fall or be shaken out of the receptacles 2, 2' at the back through the openings 32. Naturally, such openings can also be provided in the receptacles of FIG. 3.

The exemplary embodiments of FIG. 3 and FIGS. 6 and 7 may also be combined, so that the suspension unit that is normally carried on a suspension device also has a surface it can stand on, or in other words is a portable device that can also stand on a surface. It should also be mentioned that naturally the device can not only be worn on the body on hanger straps 4 as shown in FIGS. 1 and 2, but also on a belt or the like.

The temperature heating or temperature regulation should preferably be adjustable. To that end, an adjusting knob 35 is provided. The adjustability should be embodied such that the scissors can be heated to between 130° C. and 250° C.

The present invention makes it possible to carry out the following kind of procedure: before cutting with a pair of scissors that has been heated in a device for heating scissors, the previously carefully dried hair is sprayed, at the places where cutting will be done, with hydrolyzed keratin ("liquid hair") until saturated. Next, these places are dried completely once again, and as a result the applied keratin bonds to the keratin of the hair itself. In cutting using a heated pair of scissors at a temperature at which the keratin, in other words the fundamental substance of the hair, melts, the keratin previously additionally applied by spraying bonds to the keratin of the hair at the cut place. In this way, at this vulnerable place in the hair the "sealing" of the end is advantageously improved. It therefore in particular becomes more resistant to mechanical and chemical factors.

I claim:

1. A device for heating scissors to be used in cutting hair, comprising:

at least two scissors receptacles each defining a space for receiving a respective scissor; each space defining an upper and lower opening;

heating means for each receptacle, said heating means being provided inside a respective receptacle and surrounding said space in which the scissor is received;

temperature regulating means connected to said heating means for regulating the heat applied to said scissors; and indicator means connected to said heating means for indicating that the scissors have reached a certain temperature.

2. The device as defined in claim 1, further comprising:

attachment means worn on the body of a person to which said device is attached.

3. The device as defined in claim 2, wherein said attachment means is worn around the neck and shoulder of the person.

4. The device as defined in claim 1, further comprising:

a base to which the remainder of said device is mounted.

5. The device as defined in claim 4, further comprising:

a bracket and an arm extending down from said bracket, the remainder of said device extending from said arm, wherein said bracket is attached to said base.

6. The device as defined in claim 4, wherein each receptacle is inclined to the rear and downward relative to said base.

7. The device as defined in claim 1 in combination with scissors, wherein the scissors are provided with handles of highly insulating plastic, and wherein toward the blade of the scissors the handles have stop widened portions for the index finger of the user.

8. The device as defined in claim 7 in combination with scissors, wherein the handles of the scissors are provided with heat dissipating openings.

9. The device as defined in claim 7 in combination with scissors, wherein the blades of the scissors have bare pats which are burnished.

10. The device as defined in claim 1, wherein said temperature regulating means adjusts the temperature of said heating means to between a 150 to 250° C.

* * * * *